US005219088A

United States Patent [19]

Reina

[11] Patent Number: 5,219,088

[45] Date of Patent: Jun. 15, 1993

[54] FIXING RING FOR SECURING A CLOSURE TO A CONTAINER

[76] Inventor: Giancarlo Reina, via P. Busnelli, 34, 21047 Saronno, (Prov. of Varese), Italy

[21] Appl. No.: 877,922

[22] Filed: May 4, 1992

[30] Foreign Application Priority Data

May 7, 1991 [IT] Italy ..... MI91 U 000389

[51] Int. Cl.[5] ..... B65D 45/34

[52] U.S. Cl. ..... 220/321; 292/256.69

[58] Field of Search ..... 220/319, 320, 321; 292/256.69

[56] References Cited

U.S. PATENT DOCUMENTS

| | | | |
|---|---|---|---|
| 2,011,044 | 8/1935 | Fetter . | |
| 2,049,848 | 8/1936 | Lockhart | 292/256.69 |
| 2,194,162 | 3/1940 | Conner | 292/256.69 |
| 2,319,762 | 5/1943 | Bruning . | |
| 3,103,293 | 9/1963 | Beutler | 220/321 |
| 4,101,156 | 7/1978 | Santoni | 292/256.69 |
| 5,020,839 | 6/1991 | Kalb | 292/256.69 |

FOREIGN PATENT DOCUMENTS

| | | |
|---|---|---|
| 2908602 | 9/1980 | Fed. Rep. of Germany . |
| 483345 | 12/1969 | Switzerland . |

*Primary Examiner*—Allan N. Shoap
*Assistant Examiner*—Nova Stucker
*Attorney, Agent, or Firm*—Guido Modiano; Albert Josif

[57] ABSTRACT

The fixing ring for securing a closure to a container includes: a ring-like body which is open at one point and which can engage the peripheral edge of a closure and the mouth of a container; a lever which is pivoted to one end of the ring-like body and which extends toward the region delimited by the ring-like body itself; and a traction element having one end articulated to the median portion of the lever and another end articulated to the other end of the ring-like body, and the lever which, in its closure position, at least partially overlaps the ring-like body.

6 Claims, 2 Drawing Sheets

FIXING RING FOR SECURING A CLOSURE TO A CONTAINER

BACKGROUND OF THE INVENTION

The present invention relates to a fixing ring for securing a closure to a container.

As is known, in many industrial fields and in particular in the case of drums, it is necessary to be able to sealingly apply a closure to the mouth of a container in order to close it.

Ring-like devices are already known which substantially have a split-ring body on the outside of which a lever is pivoted; said lever is articulated, in a median portion, to a traction element which is connected to the other end of the split ring, so that when the lever is moved toward the ring-like body it secures it and fixes the closure to the container.

However, this embodiment has the drawback according to which the bulk of the lever, in closure position, protrudes with respect to the outer peripheral region of the drum, thereby increasing the chance of occurrence of impacts which can damage the lever and consequently make the coupling of the closure unstable.

Another problem is furthermore constituted by the fact that there are difficulties in applying so-called guarantee seals, which are in practice constituted by laminae which insert in a snap-together manner in a slot defined on the lever and in a corresponding slot defined on the closure.

Since the lever is on the outside of the ring-like body, it is necessary to provide barriers which prevent the fraudulent extraction of the lamina from its seat.

On the other hand, it is known to use ring-like closure bodies which do not have an external bulk for the closure lever but instead have a relatively large body which is accommodated within the space delimited by the ring-like body, so that it is practically impossible to stack a plurality of containers. These closures additionally have considerable constructive complexities.

SUMMARY OF THE INVENTION

The aim of the present invention is to eliminate the problems described above by providing a fixing ring for securing a closure to a container, which allows not to have bulks outside the ring-like body and furthermore which leaves the central portion of the closure free as well, consequently allowing the easy stacking of the various containers.

Within the scope of the above aim, a particular object of the invention is to provide a fixing ring which allows to apply the guarantee seal or safety seal without having to resort to the subsequent application of protective barriers in order to prevent fraudulent extraction.

Another object of the present invention is to provide a fixing ring which, by virtue of its peculiar constructive characteristics, is capable of giving the greatest assurances of reliability and safety in use.

Not least object of the present invention is to provide a fixing ring for securing a closure to a container which can be easily obtained starting from commonly commercially available elements and materials and which is furthermore competitive from a merely economical point of view.

This aim, these objects and others which will become apparent hereinafter are achieved by a fixing ring for securing a closure to a container, according to the invention, characterized in that it comprises a ring-like body which is open at one point and can engage the peripheral edge of a closure and the mouth of a container, a lever being pivoted to one end of said ring-like body, said lever extending toward the region delimited by said ring-like body, the end of a traction element being articulated to a median portion of said lever, said traction element being articulated to the other end of said ring-like body, said lever, in closure position, being at least partially superimposed on said ring-like body.

BRIEF DESCRIPTION OF THE DRAWINGS

Further characteristics and advantages of the present invention will become apparent from the detailed description of a fixing ring for securing a closure to a container, illustrated only by way of non-limitative example in the accompanying drawings, wherein.

DESCRIPTION OF THE PREFERRED EMBODIMENTS

Figure 1:
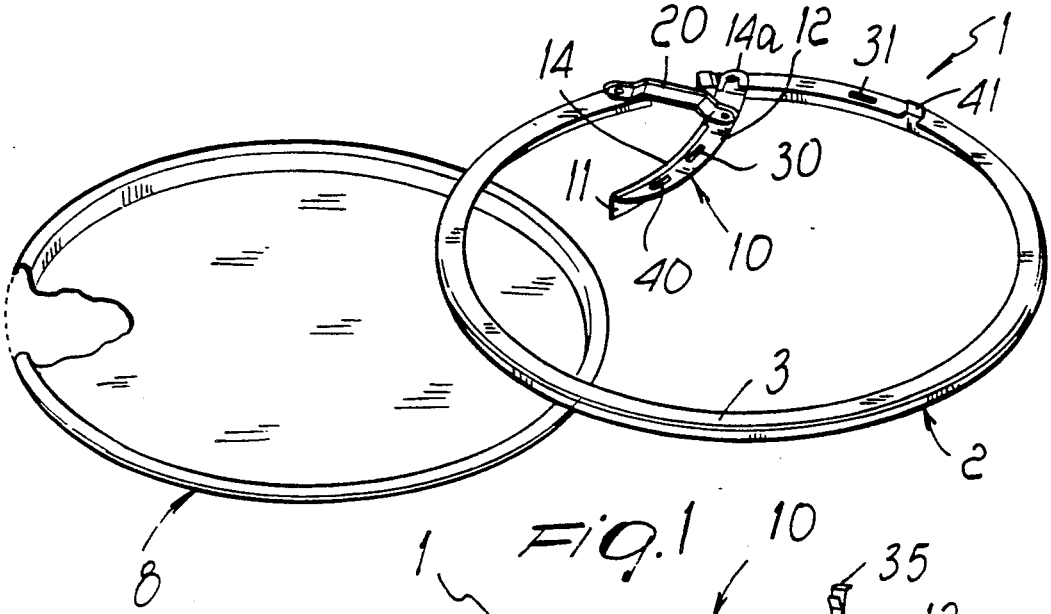
FIG. 1 is a schematic perspective view of the fixing ring in open position.
Figure 2:
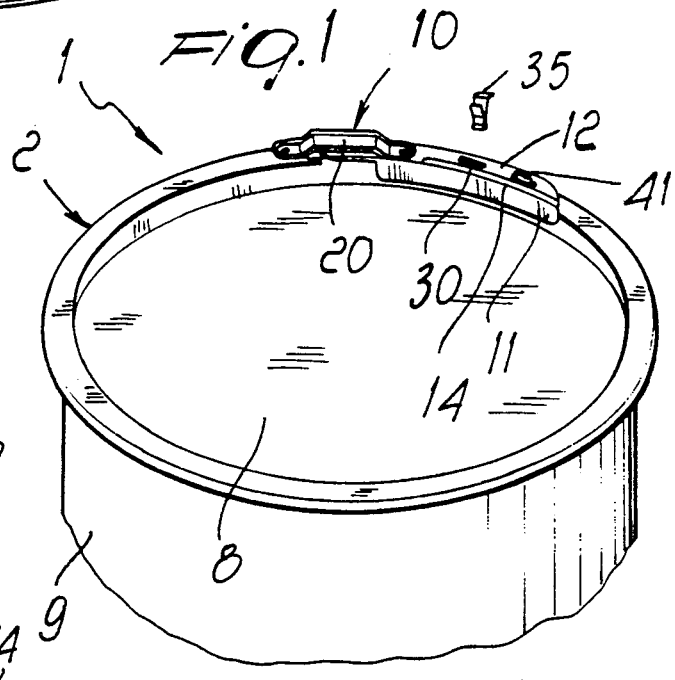
FIG. 2 is a schematic view of the fixing ring applied to a container.

With reference to the above figures, the fixing ring for securing a closure to a container, which is generally designated by the reference numeral 1, comprises a ring-like body 2 which is openable at one point.

The transverse cross-section of the ring-like body is L-shaped, with an upper wing 3.

Figure 5:
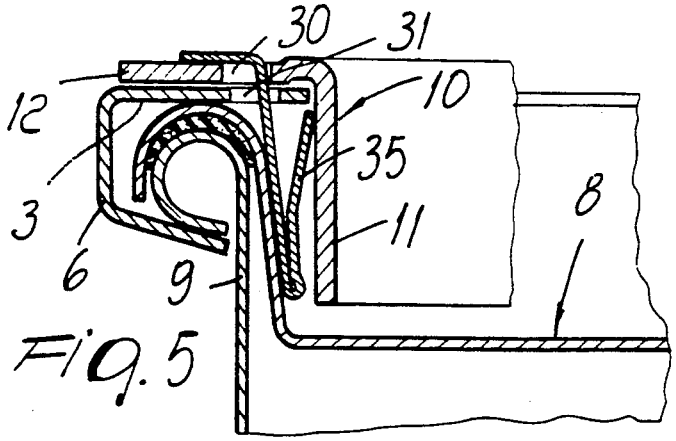
FIG. 5 is a sectional view, taken along the plane V—V of FIG. 4.

A peripheral wing 6 is connected to the upper wing and can be already folded inwardly or may be arranged substantially perpendicular to the upper wing 3 and be folded inwardly after the ring-like body, already closed onto the closure 8, has been fixed to the container 9 (FIG. 5).

Figure 3:
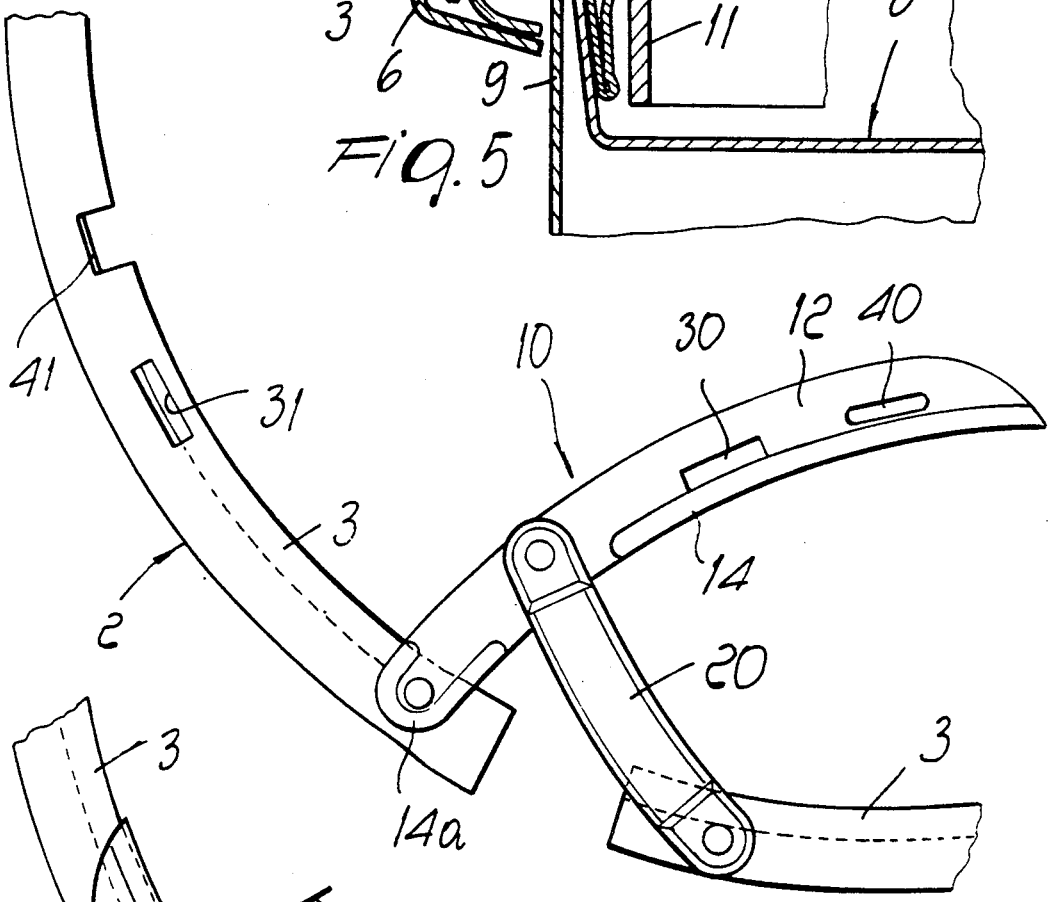
FIG. 3 is a plan view of a portion of the ring-like body in open position.
Figure 4:
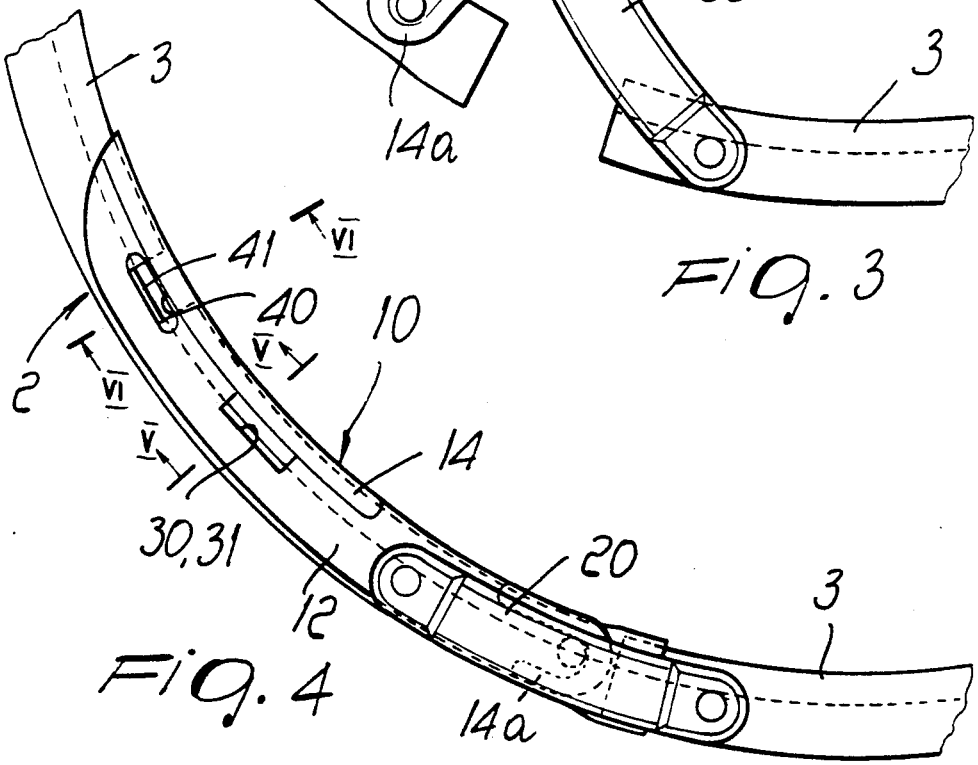
FIG. 4 is a view of the ring-like body in closure position.

Furthermore, at one end of the ring-like body, the cross-section is enlarged (FIGS. 3 and 4), so as to facilitate the overlap of the two ends in the closed position.

A lever 10 is pivoted at one end of the open ring-like body, extends (in an open position thereof) toward the inside of the region delimited by said ring-like body, and has an arc-like shape with the same radius of curvature as said ring-like body.

The transverse cross-section of the lever is shaped like a right-angled L, with an inner wing 11 arranged substantially perpendicular to an upper edge 12, which is provided with a protruding ridge 14, which is interrupted at the zone thereof at which a bridge-like traction element 20 is pivoted. A curved protruding ridge **14*a*** is also provided at the hinge zone of the lever for reinforcement thereof.

The traction element 20 is articulated to a median portion of the lever 10 and is articulated, at its other end, to the other end of the ring-like body.

Figure 6:
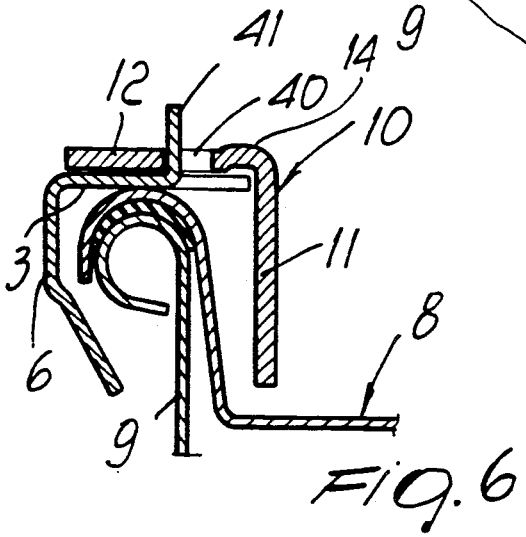
FIG. 6 is a sectional view, taken along the plane VI—VI of FIG. 4, with the blocking element unfolded.
Figure 7:
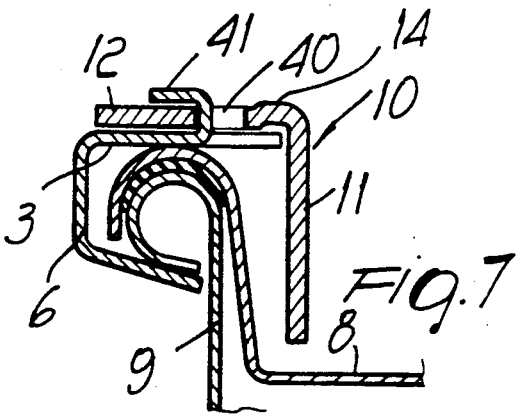
FIG. 7 is a sectional view, similar to FIG. 6, with the blocking element folded.

A slot 30 is furthermore provided on the upper edge 12 of the lever 10 and can be arranged in alignment with a lower slot 31 defined on the ring-like body which allows to insert a guarantee seal or a safety seal, designated by 35, which has the function of indicating that the lever has been opened. The lever 10 can also be provided with a blocking slot 40 in which a blocking element 41 can lockingly engage; said blocking element is advantageously obtained from a bendable cut portion of the upper wing 3 of the ring-like body 2 itself, as seen in FIGS. 6 and 7, and thus such blocking element 41 acts as a locking mechanism which helps to avoid accidental openings of the seal 35.

With this arrangement, the inner wing 11 acts as protection element for the seal, preventing its fraudulent removal without breaking it.

When the lever is in its closure position, it practically overlaps the ring-like body, so that bulks toward the outside or toward the inside of said body are not created, thus allowing to stack a plurality of containers or drums on top of one another.

From what has been described above it can thus be seen that the invention achieves the intended aim and objects, and in particular the fact is stressed that a fixing ring is provided which can be applied to a drum, during its first application, so that its outer wing can be folded in order to close the closure on the drum or possibly with the outer wing already folded, so as to correctly fix the closure to the container.

An important aspect of the invention is constituted by the fact that the lever does not create inward or outward bulks and that the guarantee seal is protected directly by the inner wing of the lever, so that its fraudulent removal is not possible, without having to perform the further application of barriers or the like.

In practice, the materials employed, so long as they are compatible with the specific use, as well as the contingent shapes and dimensions, may be any according to the requirements.

I claim:

1. A fixing ring for securing a closure to a container, comprising:

a ring-like body which is open at one point and which is engageable with a peripheral edge of the closure and a mouth of the container, said ring-like body having a substantially L-shaped transverse cross-section with an upper wing and an outer wing which extends substantially perpendicularly to the upper wing, the upper wing having a substantially circular configuration which delimits an inner circular region;

a lever being pivotally connected to a first end of said ring-like body, said lever extending, in an unlatched position thereof, toward the inner circular region delimited by the upper wing of said ring-like body; and a traction element having one end pivotally connected to a median portion of said lever and another end pivotally connected to a second end of said ring-like body;

said lever having a transverse cross-section which is substantially shaped like a right-angled L with an inner wing which extends substantially perpendicularly to an upper edge, said lever extending along a curved shape whose radius of curvature is substantially equal to a radius of curvature of said ring-like body, said lever at least partially overlapping said ring-like body when it is in a closure position with said upper edge of said lever overlapping said upper wing of said ring-like body, and with said inner wing following the circular configuration of the upper wing of said ring-like body, and said inner wing being void of any portions protruding toward the inner circular region delimited by said upper wing of said ring-like body.

2. The fixing ring of claim 1, wherein the upper edge of the lever is provided with a protruding ridge at an outer profile thereof which is interrupted at a pivoting zone of the traction element, said upper edge of the lever further comprising a curved protruding reinforcement ridge provided about a hinge zone of the lever to the ring-like body.

3. A fixing ring for securing a closure to a container, comprising a ring-like body which is open at one point and which is engageable with a peripheral edge of the closure and a mouth of the container, said ring-like body having a substantially L-shaped transverse cross-section with an upper wing and an outer wing which extends substantially perpendicularly to the upper wing, the upper wing having a substantially circular configuration which delimits an inner circular region;

a lever being pivotally connected to a first end of said ring-like body, said lever extending, in an unlatched position thereof, toward the inner circular region delimited by the upper wing of said ring-like body; and a traction element having one end pivotally connected to a median portion of said lever and another end pivotally connected to a second end of said ring-like body;

said lever having a transverse cross-section which is substantially shaped like a ring-angled L with an inner wing which extends substantially perpendicularly to an upper edge, said lever extending along a curved shape whose radius of curvature is substantially equal to a radius of curvature of said ring-like body, said lever at least partially overlapping said ring-like body when it is in a closure position with said upper edge of said lever overlapping said upper wing of said ring-like body, and with said inner wing following the circular configuration of the upper wing of said ring-like body, and said inner wing being void of any portions protruding toward the inner circular region delimited by said upper wing of said ring-like body, the fixing ring further comprising:

a lower slot provided in the upper wing of the ring-like body;

an upper slot provided in the upper edge of said lever and which is arrangeable in alignment with said lower slot when the lever is in the closure position; and a guarantee seal inserted through both said lower slot and said upper slot with said lever in the closure position, said inner wing of the lever partially covering said guarantee seal.

4. A fixing ring for securing a closure to a container, comprising:

a ring-like body which is open at one point and which is engageable with a peripheral edge of the closure and a mouth of the container, said ring-like body having a substantially L-shaped transverse cross-section with an upper wing and an outer wing which extends substantially perpendicularly to the upper wing, the upper wing having a substantially circular configuration which delimits an inner circular region;

a lever being pivotally connected to a first end of said ring-like body, said lever extending, in an unlatched position thereof, toward the inner circular region delimited by the upper wing of said ring-like body; and a traction element having one end pivotally connected to a median portion of said lever and another end pivotally connected to a second end of said ring-like body;

said lever having a transverse cross-section which is substantially shaped like a right-angled L with an inner wing which extends substantially perpendicularly to an upper edge, said lever extending along a curved shape whose radius of curvature is substantially equal to a radius of curvature of said ring-like body, said lever at least partially overlapping said ring-like body when it is in a closure position with said upper edge of said lever overlapping said upper wing of said ring-like body, and with said inner wing following the circular configuration of the upper wing of said ring-like body, and said inner wing being voided of any portions protruding toward the inner circular region delimited by said upper wing of said ring-like body, the fixing ring further comprising:

a blocking slot provided in the upper edge of said lever; and a blocking element provided on said upper wing of said ring-like body, said blocking element being constituted by a bendable cut portion of the upper wing of said ring-like body, said blocking element being inserted through said blocking slot of said upper edge of said lever in the closure position thereof, and said blocking element being bent in a direction away from the inner circular region delimited by said upper wing of said ring-like body for locking the lever in the closure position.

5. The fixing ring of claim 4, further comprising:

a lower slot provided in the upper wing of the ring-like body;

an upper slot provided in the upper edge of said lever and which is arrangeable in alignment with said lower slot when the lever is in the closure position; and a guarantee seal inserted through both said lower slot and said upper slot with said lever in the closure position, said inner wing of the lever partially covering said guarantee seal.

6. The fixing ring of claim 5, wherein the upper edge of the lever is provided with a protruding ridge at an outer profile thereof which is interrupted at a pivoting zone of the traction element, said upper edge of the lever further comprising a curved protruding reinforcement ridge provided about a hinge zone of the lever to the ring-like body.

* * * * *